US005718736A

United States Patent [19]

Onishi et al.

[11] Patent Number: 5,718,736

[45] Date of Patent: Feb. 17, 1998

[54] POROUS ULTRAFINE GRINDER

[75] Inventors: Hitoshi Onishi, Niigata-ken; Kozo Ishizaki, 1-7 Yukigaya, Otsuka-cho, Ota-ku, Tokyo, both of Japan

[73] Assignees: Alps Electric Co., Ltd., Tokyo; Kozo Ishizaki, Niigata, both of Japan

[21] Appl. No.: 723,931

[22] Filed: Oct. 2, 1996

[30] Foreign Application Priority Data

Oct. 9, 1995 [JP] Japan ..... 7-261841

[51] Int. Cl.[6] ..... B24D 3/10; B24D 5/00

[52] U.S. Cl. ..... 51/307; 51/309

[58] Field of Search ..... 51/309, 307, 293

[56] References Cited

U.S. PATENT DOCUMENTS

| | | | |
|---|---|---|---|
| 4,738,689 | 4/1988 | Gigi et al. | 51/309 |
| 4,951,427 | 8/1990 | St. Pierre | 51/309 |
| 4,977,710 | 12/1990 | Une | 51/309 |
| 5,011,510 | 4/1991 | Hayakawa et al. | 51/309 |
| 5,385,591 | 1/1995 | Ramanath et al. | 51/309 |
| 5,637,123 | 6/1997 | Ishizaki et al. | 51/296 |

FOREIGN PATENT DOCUMENTS 5-277952 10/1993 Japan .

*Primary Examiner*—Deborah Jones
*Attorney, Agent, or Firm*—Guy W. Shoup

[57] ABSTRACT

The present invention provides a porous ultrafine grinder including ultrafine abrasive grains of diamond or cubic boron nitride having an average grain size of 60 μm or less, and a binder which can form a fused phase by fusion with the ultrafine abrasive grains under heating. The binder is a porous material having continuous pores, and the fused phase formed in the interface of the binder and the ultrafine abrasive grains has a thickness of 1.5 μm or less.

19 Claims, 3 Drawing Sheets

POROUS ULTRAFINE GRINDER

BACKGROUND OF THE INVENTION

1. Field of the Invention

The present invention relates to a porous ultrafine grinder used in the field of precision processing, and particularly to a porous ultrafine grinder having high efficiency and excellent strength, and a production method therefor.

2. Description of the Related Art

Since abrasive grains of diamond or cubic boron nitride (referred to as "cBN" hereinafter) have extremely high strength, the grains are known as "ultrafine abrasive grains" and frequently used for precision grinding of steel, high-strength metals, glass, ceramics, stone materials, etc.

An ultrafine grinder (simply referred to as a "grinder" hereafter) comprising ultrafine abrasive grains is generally produced by bonding ultrafine abrasive grains with a binder and molding. Grinders produced by using a synthetic resin, a vitreous binder and a metal as binders are referred to as a resin-bonded grinder, a vitrified grinder and a metal-bonded grinder, respectively. These grinders are properly used in accordance with the characteristics of workpieces to be ground.

Recently, as high-density elements, typically, integrated circuits manufactured by using a thin film process, have been developed and popularized, fine cutting has been required in which the width of a cutting allowance of a substrate is decreased to, for example, 0.3 mm or less, for the economical reason. Therefore, a sharp-edged grinder which enables such fine cutting has been required.

Most of conventional sharp-edged grinders used for the fine grinding are metal-bonded grinders from the viewpoint of strength. A metal-bonded grinder is produced by an electrocasting or sintering process using Ni or a bronze alloy as a binder. However, since a binder phase has a close texture, dressing is difficult, and an electrolytic process or the like which requires complicated expensive technology and apparatus must be used for dressing.

Namely, in order to activate a grinder, it is necessary to project a cutting edge made of ultrafine abrasive grains from the surface of the binder phase. In a grinder as a molded product, the ultrafine abrasive grains and the binder phase are generally at the same level on the surface of the grinder. In order to project the cutting edge made of ultrafine abrasive grains in this state, the surface layer of the binder phase must be removed to a certain depth, leaving the ultrafine abrasive grains. This work is known as "dressing". If the surface layer of the binder phase is smooth, it is very difficult to remove only the surface layer of the binder phase, leaving the ultrafine abrasive grains, by a scratching method, for example. A complicated expensive method such as an electrolytic process is thus required in which the surface layer of the binder phase is removed by elution.

On the other hand, a vitrified grinder is generally produced by molding a mixture of ceramic grains as a binder and ultrafine abrasive grains, and then sintering the molded product under pressure. Since the binder phase of the vitrified grinder is porous and has a coarse texture, special dressing is unnecessary. In addition, since grinding chips produced in a grinding work are caught by pore pockets and are removed, loading hardly occurs. Even if the cutting edge made of fine abrasive grains is worn, since the binder phase is coarse and brittle, the cutting edge is appropriately broken to produce a new cutting edge, and dulling thus hardly occurs.

However, since the vitrified grinder has not only the brittle binder phase but also weak bonding strength between the binder and the ultrafine abrasive grains, the grinder cannot be formed to have a sharp edge having a thickness of, for example, 0.3 mm or less, and breaking easily occurs. When a high-hardness workpiece to be ground, which is hardly ground, is ground under high pressure, therefore, the vitrified grinder is significantly worn and is thus not economical.

In order to obtain a grinder having high grinding efficiency, high strength and high bonding strength between a binder and ultrafine abrasive grains, it is thought to render the metal-bonded grinder porous by forming pores in the texture thereof. This porous metal-bonded grinder can be produced by mixing ultrafine abrasive grains and binder metal grains, compression-molding the mixture in the shape of a grinder, and sintering the molded product at temperature and pressure which produce bonding between the respective binder metal grains while maintaining the granular form, and between the binder metal grains and the ultrafine abrasive grains.

The thus-produced porous metal-bonded grinder has high bonding strength between the binder and the ultrafine abrasive grains, and good dressing properties due to the coarseness of the binder phase. It is also expected that, since grinding chips produced in a grinding work are caught by the pore pockets and are removed, loading hardly occurs, and that, even if the cutting edge made of fine abrasive grains is worn, the cutting edge is appropriately broken to produce a new cutting edge because of the coarse binder phase, and dulling thus hardly occurs.

Although the porous metal-bonded grinder has high bonding strength between the ultrafine abrasive rains and the binder, if the porosity is increased, and if the cutting edge made of the ultrafine abrasive grains is projected to improve the cutting quality of the grinder, the grinder is significantly worn due to much breaking. If the porosity is decreased, and if the height of the cutting edge is decreased, although breaking is decreased, the worn ultrafine abrasive grains do not fall off, thereby causing a problem in that loading and dulling easily occur. In order to solve this problem, a technique is demanded in which the bonding strength between the ultrafine abrasive grains and the binder is controlled so as to prevent breaking, while maintaining an appropriate porosity.

SUMMARY OF THE INVENTION

The present invention has been achieved for solving the above problems, and an object of the present invention is to provide a porous ultrafine grinder having high bonding strength between ultrafine abrasive grains and a binder, well-balanced improved dressing, breaking, loading and dulling properties, and strength which permits the use as a sharp-edged grinder for fine processing. Another object of the invention is to provide a method of producing the porous ultrafine grinder.

In order to achieve the above objects, in an aspect of the present invention, there is provided a porous ultrafine grinder comprising ultrafine abrasive grains consisting of diamond or cBN having an average grain size of 60 μm or less, and a binder which can form a fused phase by fusion with the ultrafine abrasive grains under heating, wherein the binder is a porous material having continuous pores, and the fused phase is formed in the interfaces between the binder and the ultrafine abrasive grains and has a thickness of 1.5 μm or less.

The "fused phase" means a phase which is formed by atom mixing of the ultrafine abrasive grains and the binder due to thermal diffusion in the contact interfaces therebetween, and which comprises an eutectic mixture, a solid solution or a compound.

The binder preferably comprises at least one selected from the group consisting of single elements of Fe, Cu, Ni, Co, Cr, Ta, W, Ti, Si and Zr; carbides of Co, Cr, Ta, V, Nb, W, Ti, Si and Zr; oxides of Ti, Si, Al, Ce, Mg, Fe and Zr; nitrides of Ta, Ti and Si and borides of Ta, Ti and Si.

The fused phase preferably has a thickness within the range of 0.05 to 0.5 μm.

The porosity of the porous ultrafine grinder is preferably within the range of 5 to 60%, and more preferably within the range of 5 to 45%.

The fused phase preferably comprises the ultrafine abrasive grains and at least one selected from the group consisting of Ti, Ni, Fe, Si, Ta, W, Cr and Co. The fused phase may contain Cu or Ag.

In another aspect of the present invention, there is provided a method of producing the porous ultrafine grinder comprising the steps of mixing ultrafine abrasive grains of diamond or cBN having an average grain size of 60 μm or less, and binder grains which can form a fused phase by fusion with the ultrafine abrasive grains under heating; molding the resultant grain mixture; and sintering the molded product at temperature and pressure which are adjusted to form the fused phase having a thickness of 1.5 μm or less in the interfaces between the ultrafine abrasive grains and the binder grains, and to sinter the binder grains with a porosity within the range of 5 to 60%.

The binder grains comprise at least one selected from the group consisting of single elements of Fe, Cu, Ni, Co, Cr, Ta, W, Ti, Si and Zr; carbides of Co, Cr, Ta, V, Nb, W, Ti, Si and Zr; oxides of Ti, Si, Al, Ce, Mg, Fe and Zr; nitrides of Ta, Ti and Si and borides of Ta, Ti and Si. The average size of the binder grains is preferably within the range of 5 to 50% of the average size of the ultrafine abrasive grains.

The temperature and pressure applied in sintering are preferably adjusted to form the fused phase having a thickness within the range of 0.05 to 0.5 μm in the interfaces between the ultrafine abrasive grains and the binder grains.

The sintering temperature and pressure are preferably adjusted to produce porosity within the range of 5 to 45%.

The ultrafine abrasive grains are preferably metal-coated ultrafine abrasive grains comprising at least one selected from the group consisting of Ti, Ni, Fe, Si, Ta, W, Cr and Co, and coated with a metallic layer having a thickness of 1.5 μm or less. In sintering, the temperature and pressure are preferably adjusted to bond the ultrafine abrasive grains and the binder grains with the metallic layer as the fused phase therebetween. Alternatively, the ultrafine abrasive grains are grains coated with a coating layer of any of the above binders containing Cu or Ag, and the sintering temperature and pressure are preferably adjusted to bond the ultrafine abrasive grains and the binder grains with the coating layer as the fused phase therebetween.

Sintering is preferably carried out by a spark plasma sintering process at a temperature within the range of 600° to 2000° C. and pressure within the range of 5 to 50 MPa. Alternatively, sintering is preferably carried out by a hot-press sintering process at a temperature within the range of 600° to 2000° C. and pressure within the range of 5 to 50 MPa

DETAILED DESCRIPTION OF THE PREFERRED EMBODIMENTS

Embodiments of the present invention are described with reference to the drawings.

Embodiment 1

Figure 1:
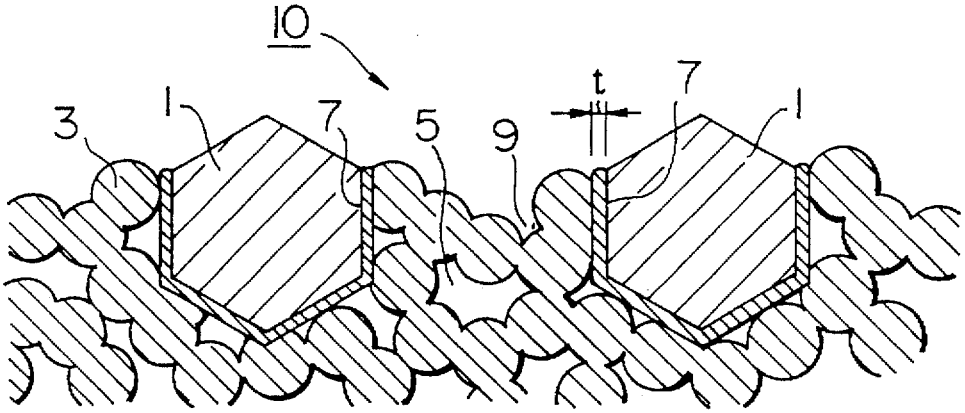
FIG. 1 is a schematic sectional view of a surface layer of a porous ultrafine grinder in accordance with an embodiment of the present invention.

FIG. 1 schematically show the construction of a surface layer of a porous ultrafine grinder (referred to as a "grinder of this invention" hereinafter) in an embodiment of the present invention.

Referring to FIG. 1, in this embodiment, a grinder 10 of this invention comprises ultrafine abrasive grains 1 consisting of a diamond single crystal having an average grain size of 20 to 30 μm (#660), the ultrafine abrasive grains being fixed by a binder 3 consisting of a single element Ni which can form a fused phase by fusion with the ultrafine abrasive grains 1 under heating. In a phase of this binder 3 (binder phase), many continuous pores 5 are formed, and thus the grinder 10 of this invention is made a porous grinder having a porosity of 39%, i.e., porosity within the range of 5 to 60%.

In the grinder 10 of this invention, a fused phase 7 is formed in the contact interfaces of the ultrafine abrasive grains 1 and the binder 3 due to atomic diffusion from one or both of the abrasive grains 1 and the binder 3. In this embodiment, the fused phase 7 has a thickness t of about 0.43 μm, i.e., 1.5 μm or less.

Figure 2:
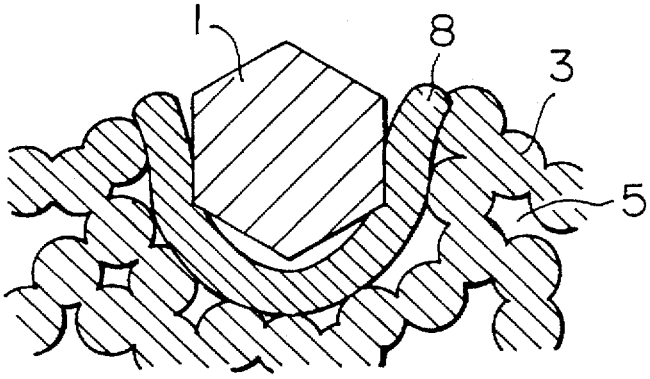
FIG. 2 is a schematic sectional view illustrating an example of a grinder in which a fused phase is excessively thick.

Since, in the grinder 10 of this invention, the ultrafine abrasive grains 1 and the binder 3 are strongly bonded by the fused phase 7 having the above-described limited thickness, the ultrafine abrasive grains 1 do not uselessly drop out of the binder 3 during a grinding work. It was found that, if the thickness of the fused phase 7 exceeds 1.5 μm, as shown in FIG. 2, a fused phase 8 separates from the ultrafine grains 1, thereby decreasing the bonding strength between the ultrafine abrasive grains 1 and the binder 3.

Since the grinder 10 of this invention has the porous binder phase, it has a rough surface, and can thus be dressed automatically during the grinding work without using complicated means such as electrolytic dressing means. In addition, since the grinder 10 of this invention has high porosity, the cutting edge made of the ultrafine abrasive grains 1 is highly projected from the surface level of the binder 3, and cutting quality is improved.

Further, since the grinder 10 of this invention has the porous binder phase having continuous pores 5, a coolant can be circulated through the pores 5 for increasing the effect of cooling the grinder 10. Grinding chips produced in the grinding work are caught by pockets 9 formed by the pores 5 in the surface, and are removed to the outside of the system, thereby preventing loading of the grinder 10.

Since the binder 3 becomes brittle to some extent due to the presence of the pores 5, when grinding is carried out until the cutting edge made of the ultrafine abrasive grains 1 is worn, the worn ultrafine abrasive grains 1 are stripped off together with a portion of the binder 1 bonded thereto through the fused phase 7, thereby preventing dulling. In addition, since the outermost layer of the grinder is removed, the ultrafine abrasive grains 1 contained in the internal layer newly appear on the surface, and the grinding force of the grinder 10 of this invention is thus maintained.

The grinder 10 of Embodiment 1 of the present invention was produced by the following method.

The ultrafine abrasive grains 1 of #660 synthetic diamond and Ni powder having a purity of 99.5% or more and an average grain size of 5 μm were mixed at a ratio by volume of 3 (ultrafine grains):4 (binder), and a doughnut-shaped die of a spark plasma sintering apparatus was filled with the resultant powder mixture. Sintering was then performed at 800° C. and 10 MPa for 5 minutes to obtain the grinder 10 of Embodiment 1 as a doughnut-shaped sintered product having an outer diameter of 92 mm, an inner diameter of 40 mm and a thickness of 0.3 mm. The porosity of the grinder 10 was 39%. As a result of measurement of the thickness of the fused phase 7 by an electron microscope, the thickness was about 0.1 μm. No space was observed in the interfaces of the ultrafine abrasive grains 1 and the fused phase 7.

A cutting test was performed on the grinder of Embodiment 1 as a sample by a constant-pressure grinding method using a tool grinder. The sample was dressed by using GC #240 stick. A ceramic block having the composition $Al_2O_3$.TiC (referred to as "$Al_2O_3$.TiC ceramic" hereinafter), bending strength of 588 MPa, Vickers hardness of 19.1 GPa and a sectional area of 2 mm by 5 mm was used as a workpiece to be ground.

A doughnut-shaped metal-bonded grinder produced by an electrodeposition process and having an outer diameter of 92 mm, an inner diameter of 40 mm and a thickness of 0.3 mm was dressed by ELID and used as a comparative sample. When the grinding speed of this comparative sample was compared with the grinder sample of Embodiment 1, the sample of Embodiment 1 could cut the workpiece to be ground at a grinding speed of 1.5 times the speed of the comparative sample. This result indicates that the grinder of Embodiment 1 has higher grinding efficiency than that of a conventional metal-bonded grinder.

As shown in FIG. 1, the grinder according to Embodiment 1 of the present invention comprises the ultrafine abrasive grains 1 and the binder 3, the binder phase is a porous phase having the continuous pores, and the fused phase 7 is formed in the interfaces of the binder 3 and the ultrafine abrasive grains 1.

The ultrafine abrasive grains 1 comprise any one of single crystal or polycrystalline diamond, and single crystal or polycrystalline cBN (cubic boron nitride), or a mixture of at least two of these materials, and have an average grain size of 60 μm or less. With the ultrafine abrasive grains having an average grain size over 60 μm, since a surface to be ground is roughly finished, the grinder is unsuitable for use in fine grinding in which, for example, a substrate is cut with a grinding allowance of 0.3 mm or less, or lapping.

For example, a workpiece to be ground such as a ceramic material is finely processed, ultrafine abrasive grains of diamond having the highest hardness are preferably used. Diamond may be any one of single crystal diamond, polycrystalline diamond, natural diamond, and synthetic diamond.

When an iron-based workpiece is ground, since use of diamond brings about a problem, cBN is preferably used. cBN may be either a single crystal or polycrystalline.

Any binder which can form a fused phase in the interfaces between the binder and the selected ultrafine abrasive grains 1 under heating can be used as the binder 3 together with the ultrafine abrasive grains 1. However, the binder 3 of the grinder of this invention for precision grinding more preferably comprises any one of single elements of Fe, Cu, Ni, Co, Cr, Ta, V, Nb, W, Ti, Si and Zr; carbides of Co, Cr, Ta, W, Ti, Si and Zr; oxides of Ti, Si, Zr, Al, Ce, Mg and Fe; nitrides of Ta, Ti and Si; and borides of Ta, Ti and Si; or a mixture of at least two of these materials.

When the binder 3 in contact with the ultrafine abrasive grains 1 is heated to a temperature, for example, within the range of 600° to 2000° C., diffusion of atoms takes place in the interfaces to form the fused phase 7 comprising a eutectic mixture, a solid solution or a compound, as shown in FIG. 2.

The ultrafine abrasive grains 1 and the binder 3 are strongly bonded together with the fused phases 7. Even if the grinder is deeply dressed for improving the cutting quality to cause a relatively small contact area between the ultrafine abrasive grains 1 and the binder 3, therefore, the ultrafine abrasive grains 1 hardly drop out off uselessly during the grinding work.

However, it was found that, if the thickness of the fused phase is excessively large, the fused phase 8 separates from the ultrafine abrasive grains 1, as shown in FIG. 2. This is possibly due to the fact that the excessive formation of the fused phase causes the formation of a depletion layer and the generation of horizontal shear stress due to the high mobility of C of diamond or N of cBN to the contact interfaces, and the fact that, since the ultrafine abrasive grains 1 and the fused phase 8 have different coefficients of thermal expansion, wrinkles occur in the fused phase 8 due to thermal changes.

From this viewpoint, the thickness of the fused phase 7 of the grinder 10 of this invention is preferably 1.5 μm or less, more preferably 0.5 μm or less.

Figure 3:
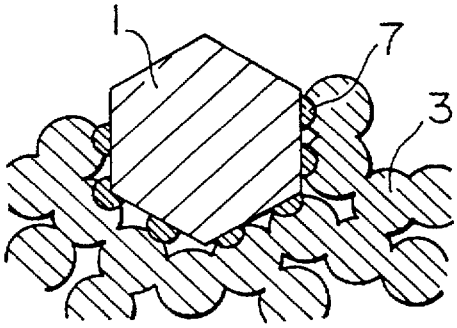
FIG. 3 is a schematic sectional view illustrating an example of a grinder in which a fused phase is not sufficiently formed.

On the other hand, it was also found that, if the thickness of the fused phase 7 is excessively small, the fused phase 7 is not uniformly formed on the surfaces of the ultrafine abrasive grains 1, but the surfaces of the ultrafine abrasive grains 1 are studded with island-like fused phases, as shown in FIG. 3. In this case, the binder 3 is not sufficiently bonded to the ultrafine abrasive grains 1.

Although the minimum thickness sufficient for uniformly forming the fused phase 7 on the surfaces of the ultrafine abrasive grains 1 depends upon the types and average grain sizes of the ultrafine abrasive grains and the binder 3, and the temperature, pressure and time necessary for production, the thickness is generally about 0.05 mm. From this viewpoint, the thickness of the fused phases 7 is preferably 0.05 mm or more.

The thickness of the fused phase 7 can be controlled by adjusting the temperature and time for sintering and molding of a powder mixture of the ultrafine abrasive grains 1 and the binder 3. Since the temperature and time depend upon the types and grain sizes of the selected ultrafine abrasive grains and binder 3, the sintering method and apparatus used, and the sintering pressure applied, the preferable actual temperature must be determined by experiment. The selected temperature range is generally 600° to 2000° C.

The grinder of this invention is porous and has a porosity within the range of 5 to 60%, preferably within the range of 5 to 45%.

With a porosity of less than 5%, the volume of the pockets formed by the pores is insufficient, and the coolant is not sufficiently circulated, thereby easily causing loading. With a porosity over 45%, particularly over 60%, the physical properties of the binder phase deteriorate, thereby easily causing breaking and dulling of the cutting edge, and breakage of a sharp-edged grinder.

When the porous grinder of this invention is produced, a powder of the binder 3 and the ultrafine abrasive grains 1 are mixed, and a die is filled with the powder mixture, followed by sintering of the ultrafine abrasive grains and the binder grains (3*p*) and the respective binder grains 3*p*. In this case, the porosity can be adjusted to a preferable range by appropriately controlling the average grain sizes of the ultrafine abrasive grains 1 and the binder grains 3*p*, the mixing ratio, the sintering pressure, the sintering temperature and the sintering time.

Figure 4A:
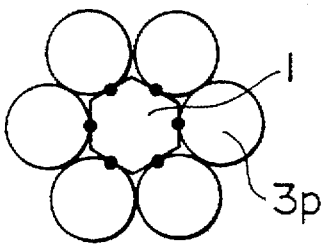
FIGS. 4A and 4B are each a schematic sectional view illustrating the relation between the grain sizes of ultrafine abrasive grains and binder grains.

The average grain size of the binder grains 3*p* is preferably within the range of 5 to 50% of the average size of the ultrafine abrasive grains 1. If the grain size ratio of the binder grains 3*p* to the ultrafine abrasive grains 1 is close to 1:1, even in a closely filled state, the ultrafine abrasive grains 1 and the binder grains 3*p* have a small number of contact points, as schematically shown in FIG. 4A. This causes insufficient bonding strength during sintering, and thus easily causes breaking of the grinder.

Figure 4B:
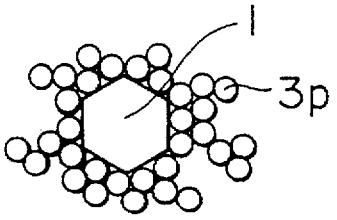

If the grain size ratio of the binder grains 3*p* to the ultrafine abrasive grains 1 is within the range of 1:0.05 to 0.5, as schematically shown in FIG. 4B, since the ultrafine abrasive grains 1 and the binder grains 3*p* have a sufficient number of contact points, the fused phase 7 is formed in a film over the substantially entire surface of each of the ultrafine abrasive grains 1 during sintering, thereby increasing the bonding strength between the ultrafine abrasive grains 1 and the binder 3 and maintaining a proper porosity.

If the grain size ratio of the binder grains 3*p* to the ultrafine abrasive grains 1 is smaller than 1:0.05, although the bonding strength in sintering has no problem due to a sufficient number of contact points, the porosity and pore size are decreased, and the sintered product thus makes no great difference from a nonporous metal-bonded grinder.

Figure 5:
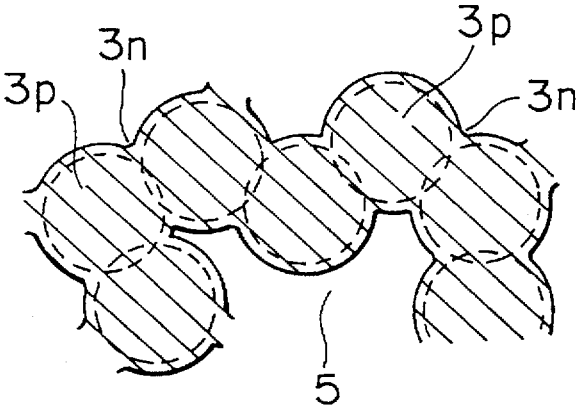
FIG. 5 is a schematic sectional view illustrating a state wherein binder grains are sintered.

When the die is filled with the ultrafine abrasive grains 1 and the binder grains 3, followed by sintering under application of pressure and temperature, the binder grains 3*p* are partially melted, and the binder grains 3*p* which contact the ultrafine abrasive grains 1 spread on the surfaces of the ultrafine abrasive grains to form the fused phase 7. When the respective binder grains 3 contact each other, fusion takes place in the contact surfaces therebetween, and thus the respective binder grains 3 are connected with necks 3*n* therebetween, to form continuous pores 5 in the non-contact portions, as shown in FIG. 5.

In sintering, the mixing ratio by volume of the ultrafine abrasive grains 1 to the binder grains 3 is preferably 1:3 to 2:1. When the ultrafine abrasive grains 1 are mixed at a ratio lower than 1:3, the grinding ability is insufficient. When the ultrafine abrasive grains 1 are mixed at a ratio higher than 2:1, the density of the ultrafine abrasive grain 1 is excessively high, thereby deceasing the strength of the sintered product and easily causing breaking of the edge.

Sintering can be carried out by any one of various conventional known methods. Of these conventional methods, a spark plasma sintering method is particularly preferable.

Figure 6:
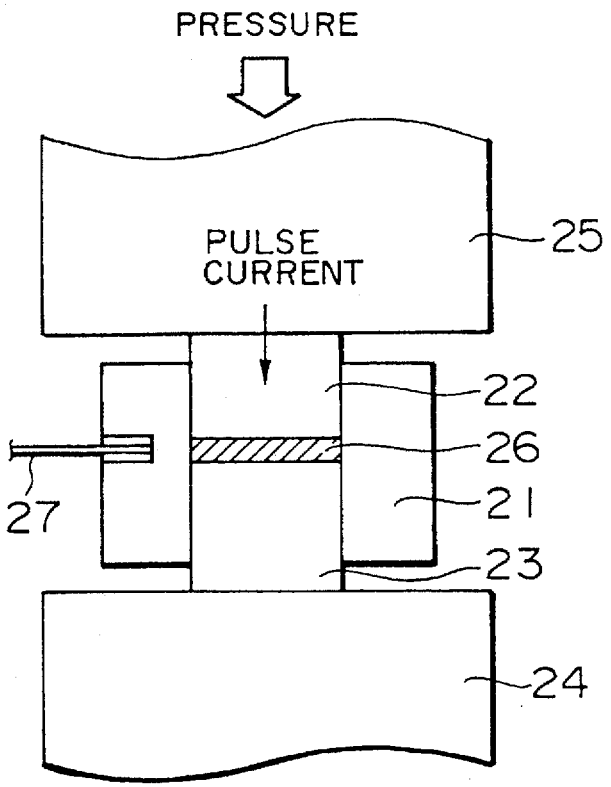
FIG. 6 is a sectional view illustrating an example of spark plasma sintering apparatus.

The spark plasma sintering method can be performed by, for example, using the spark plasma sintering apparatus shown in FIG. 6. In FIG. 6, the spark plasma sintering apparatus comprises a die 21; upper and lower punches 22 and 23; a base 24 for supporting the lower punch 23, which serves as one of electrodes for passing a pulse current, which will be described below; a base 25 for pressing the upper punch 22 downward, which serves as the other electrode for passing a pulse current; and a thermocouple 27 for measuring the temperature of a powder raw material 26 held between the upper and lower punches 22 and 23.

A current-carrying apparatus separately provided is connected to the bases 24 and 25 so as to apply a pulse current for generating a spark plasma to the upper and lower punches 22 and 23 from the current-carrying apparatus.

In this spark plasma sintering apparatus, at least a portion held between the bases 24 and 25 is contained in a chamber (not shown) which is evacuated to a vacuum and into which an atmospheric gas is introduced.

The die 21 which is formed in the predetermined shape of a grinder is filled with the powder mixture 26 of the ultrafine abrasive grains and the binder, the chamber is evacuated, and an inert atmospheric gas is introduced into the chamber. The powder mixture 26 is then compressed under pressure applied from the upper and lower punches 22 and 23, and, thereafter, a pulse current is applied thereto.

The spark plasma sintering method permits a rapid uniform increase in the temperature of the raw material powder to the sintering temperature by adjusting the electric current supplied.

An example of the spark plasma sintering apparatus which can be used for the spark plasma sintering process, is Model SPS-2050 spark plasma sintering apparatus produced by Sumitomo Sekitan-kogyo Co., Ltd.

For example, a hot press sintering method and HIP (Hot Isostatic Press), which is frequency used for sintering ceramic powders, other than the spark plasma sintering method, can be advantageously employed.

A grinder of this invention in another embodiment, which was produced by using the HIP method, is described below.

Embodiment 2

Ultrafine abrasive grains of single-crystal synthetic diamond of #1000 and a cast iron powder containing 3.11% by weight of carbon and having an average grain size of 5 μm were mixed at a ratio by volume of 1 (ultrafine abrasive grains):1.28 (binder). 2% by weight of wax as a molding auxiliary was then added to the resultant mixture, and pressurized by using a uniaxial press at pressure of 10 MPa for 1 minute to obtain a powder compression-molded product. The thus-obtained powder compression-molded product was processed in a vacuum at 800° C. for 1 hour to remove the wax and pre-burn the molded product.

After the molded product was then reshaped, it was sintered by the HIP method at 1000° C. and 200 MPa for 1 hour to obtain a sintered product. The sintered product had a porosity of 53%. When the thickness of the fused phase was measured by an electron microscope, the thickness was about 1.5 μm. As a result of observation, spaces were formed in the interfaces of the ultrafine abrasive grains and the fused phase. Therefore, the permissible upper limit of the thickness of the fused phase was decided to 1.5 μm.

The sintered product was then finished to a cap-shaped grinder as a grinder of Embodiment 2.

A cutting test was performed on the grinder of Embodiment 2 as a sample by a constant-pressure grinding method using a tool grinder. The sample was dressed by using GC #240 simple brake truer. A $Al_2O_3$.TiC ceramic block having a sectional area of 2 mm by 5 mm was used as a workpiece to be ground.

A vitrified grinder containing ultrafine abrasive grains at the same ratio as the sample of Embodiment 2 was produced as a comparative sample. When the grinding speed of this comparative sample was compared with the sample of Embodiment 2, the sample of Embodiment 2 exhibited a grinding speed of about 3 times the grinding speed of the comparative sample. This result shows that the grinder of Embodiment 2 has higher grinding efficiency than that of a conventional vitrified grinder.

Table 1 shows the optimum sintering temperature ranges for the spark plasma sintering method (referred to as "SPS method" hereinafter) and the hot press method using various binders, and the optimum sintering pressure range common to both sintering methods. In Table 1, synthetic diamond grains having an average grain size of 15 μm were used as the ultrafine abrasive grains.

TABLE 1

| Binder | SPS processing temperature | Hot press temperature | Sintering pressure |
|---|---|---|---|
| Fe | 720–960° C. | 800–1100° C. | 5–30 MPa |
| Co | 720–960° C. | 800–1100° C. | 5–30 MPa |
| Cr | 720–960° C. | 800–1100° C. | 5–30 MPa |
| Ni | 720–960° C. | 800–1100° C. | 5–30 MPa |
| Ti | 720–960° C. | 800–1100° C. | 5–30 MPa |
| Ta | 840–1080° C. | 900–1200° C. | 5–30 MPa |
| W | 960–1400° C. | 1100–1600° C. | 5–30 MPa |
| Nb | 960–1320° C. | 1100–1600° C. | 5–30 MPa |
| V | 960–1320° C. | 1100–1600° C. | 5–30 MPa |
| Zr | 960–1320° C. | 1100–1600° C. | 5–30 MPa |
| Si | 1120–1600° C. | 1200–1760° C. | 5–30 MPa |
| Mn | 720–960° C. | 800–1100° C. | 5–30 MPa |
| ZrC | 1260–1600° C. | 1300–1760° C. | 5–30 MPa |
| WC | 1180–1600° C. | 1260–1700° C. | 5–30 MPa |
| $Cr_3O_2$ | 1080–1600° C. | 1260–1700° C. | 5–30 MPa |
| $SiO_2$ | 1260–1600° C. | 800–1100° C. | 5–30 MPa |
| $TiO_2$ | 1080–1600° C. | 1160–1700° C. | 5–30 MPa |
| $ZrO_2$ | 1080–1600° C. | 1160–1700° C. | 5–30 MPa |

The porosity which is one of the three parameters of a grinder is important for improving the cutting quality by exhausting grinding chips, supplying the coolant and projecting the cutting edge from the binder phase, and improving the dressing properties. From this viewpoint, description will now be made of embodiments in which an example of the grinder of this invention is compared with a commercial nonporous cast iron-bonded grinder.

Embodiment 3

Diamond abrasive grains of #100/#110 (average grain size 180 μm) and a cast iron powder containing 3.5% by weight of carbon, having a grain size of 20 μm and produced by an atomization method were mixed at a ratio by volume of 30 (ultrafine abrasive grains):40 (binder). 2% by weight of wax was added to the resultant mixture, followed by molding. After the wax was removed by heating in a vacuum at 1000° C. for 1 hour, the molded product was sintered by the HIP method in a nitrogen atmosphere at 1120° C. and 200 MPa for 1 hour to obtain a grinder of Embodiment 3 having a porosity of 26%.

The grinder of Embodiment 3 and a commercial nonporous cast iron-bonded grinder (#100/#120) were measured with respect to the stock removal and grinding energy by a constant pressure method.

An alumina block having bending strength of 588 MPa, Vickers hardness of 19 GPa and a sectional area of 3 mm×4 mm was used as a workpiece to be ground by constant grinding.

The workpiece to be ground was pressed on the surface of each of the cap-shaped grinders at 0.4 MPa, and then ground at a peripheral speed of 1100 m/min. The grinding force and the removal amount were measured, and the stock removal (grinding volume per second) and grinding energy (grinding force×peripheral speed/removal amount) were calculated. The results obtained are shown in Table 2.

TABLE 2

| Grinder | Stock removal | Grinding energy |
|---|---|---|
| Porous cast iron-bonded grinder (porosity 26%) | 6.2 | 15 |
| Commercial non-porous cast iron-bonded grinder | 1 or less | 37 |

The results indicate that the stock removal per hour of the grinder of Embodiment 3 is 6 times or more that of the commercial nonporous cast iron-bonded grinder having porosity of substantially 0% (5% or less), and that the grinding energy of the grinder of Embodiment 3 is about 1/2.5 of that of the commercial nonporous cast iron-bonded grinder. It is obvious from this that the pores have the large effect of improving grinding efficiency.

Embodiment 4

The porosity of the grinder obtained changes with the sintering conditions even if the types and grain sizes of the ultrafine abrasive grains 1 and the binder grains 3 are constant. As an example, ultrafine grains of #1000 synthetic diamond (average grain size 10 to 20 μm) as ultrafine abrasive grains 1 and cast iron powder having an average grain size of 5 μm as binder grains 3*p* were mixed, followed by spark plasma sintering, to produce a disk-shaped grinder having a diameter of 20 mm and a thickness of 0.5 mm. The molding temperature and pressure, and the porosity of the resultant grinder were measured. The results are shown in Table 3.

TABLE 3

| Sintering temperature | Sintering pressure | Porosity |
|---|---|---|
| 720° C. | 10 MPa | 31.3% |
| 780° C. | 5 MPa | 33.4% |
| 780° C. | 10 MPa | 26.9% |
| 780° C. | 20 MPa | 20.3% |
| 840° C. | 10 MPa | 16.3% |

The results shown in Table 3 reveal that the porosity generally tends to increase as the sintering temperature and sintering pressure decrease.

With an excessively high porosity, the physical properties of the grinder deteriorate, and the grinder is thus significantly worn. The porosity also changes with the production method. Description will now be made of a porosity difference between the spark plasma sintering method (SPS method) and the HIP method, and comparison between physical properties and grinding efficiency which are affected by the porosity difference with reference to the embodiment below.

Embodiment 5

Synthetic diamond having an average grain size of 10 to 20 μm and atomized cast iron powder containing 3.11% by weight of carbon and having an average grain size of 5 μm were mixed at a ratio by volume of 25 (ultrafine abrasive grains):32 (binder). A cap-shaped grinder was produced by each of the HIP method and the SPS method using the resultant powder mixture.

As shown in Table 4, the grinder produced by the HIP method has a porosity of 53%, and the use of ultrafine abrasive grains of #1000 increases the porosity. In the SPS method, the same material was sintered at 780° C. and 720°

C. and 10 MPa to obtain grinders having porosities of 27% and 36%, respectively. Since the SPS method ia a pressure sintering method, the porosity can be controlled by appropriately selecting the pressure other than the temperature, and the SPS method is thus excellent in controllability of porosity. The hot press method which is also a pressure sintering method produces the same results as the SPS method.

Each of the grinder samples was compared with a commercial vitrified grinder by a grinding performance test using the constant pressure method. A $Al_2O_3$.TiC ceramic block having a sectional area of 2 mm by 5 mm was used as a workpiece to be ground.

The workpiece to be ground was pressed on the surface of each of the cap-shaped grinders, and then ground at a peripheral speed of 1100 m/min. The grinding force and removal amount were measured, and the grinding speed (grinding length per second) and grinding energy (grinding force×peripheral speed/removal amount) were calculated. The results are shown in Table 4 together with the test results of the commercial vitrified grind used as a comparative example.

TABLE 4

| | Porosity % | Young's modulus GPa | Grinding speed $mm^3$/sec. | Grinding energy $GJ/mm^3$ |
|---|---|---|---|---|
| SPS process 780° C., 10 Mpa | 27 | 40 | 0.8 | 70 |
| SPS process 720° C., 10 Mpa | 36 | 26 | 1.6 | 45 |
| HIP process 1000° C., 200 Mpa | 53 | 2 | 0.6 | 100 |
| Commercial vitrified grinder | 25 | 50 | 0.2 | 170 |

The results indicate that the grinders produced by the SPS method and having a porosity of 27 to 36% have sufficiently good grinding performance, as compared with the versatile commercial vitrified grinder which was said to exhibit good grinding performance under the same grinding conditions. The grinder produced by the HIP method and having a porosity of 53% had low Young's modulus, and was rapidly worn by continuous grinding for 360 seconds under grinding pressure of 1 MPa. From this viewpoint, it is found that although a grinder having high porosity can sufficiently be employed effectively for grinding at low grinding pressure, a grinder having porosity of 45% or less is preferably used for grinding at grinding pressure of over 1 MPa.

A grinder in accordance with another embodiment of the present invention is described below.

The present invention also provides a porous ultrafine grinder in which the fused phase 7 comprises ultrafine abrasive grains 1 and at least one selected from the group consisting of Ti, Ni, Fe, Si, Ta, W, Cr and Co.

As described above, it is generally important for a porous grinder to maintain the bonding strength between the ultrafine abrasive grains and the binder. In the grinder 10 of this invention, the thickness of the fused phase 7 formed in the interfaces is adjusted to prevent the formation of spaces between the ultrafine abrasive grains 1 and the fused phases 7, thereby obtaining good bonding strength. In this case, if a single element, an oxide, a nitride or a boride is used as the binder 3, spaces are sometimes formed between the ultrafine abrasive grains and the fused phase 7, and the bonding strength is thus decreased according to circumstances.

One possible cause for this is that wettability of the binder 3 to the ultrafine abrasive grains 1 is insufficient under the sintering conditions, and the fused phase 7 is formed in an island-like form, as shown in FIG. 3, thereby decreasing the bonding strength. Another possible cause is that, since the fused phase 7 having high hardness is generally formed between such a binder 3 and the ultrafine abrasive grains 1 and has a thermal expansion coefficient different from that of the ultrafine abrasive grains 1, cracks easily occur in the interfaces due to thermal changes.

Ti, Ni, Fe, Si, Ta, W. Cr and Co have good wettability to the ultrafine abrasive grains 1, and particularly, Ni, Fe, Cr and Co are materials which form the relatively soft fused phase 7 with the ultrafine abrasive grains 1. Since the fused phases 7 has high affinity for the binder 3, the ultrafine abrasive grains 1 are strongly bonded to the binder 3 with a large area due to the interposition of the fused phase 7 therebetween, and are not separated even if subjected to thermal changes. In this case, the thickness of the fused phases 7 is adjusted to 1.5 μm or less.

Figure 7:
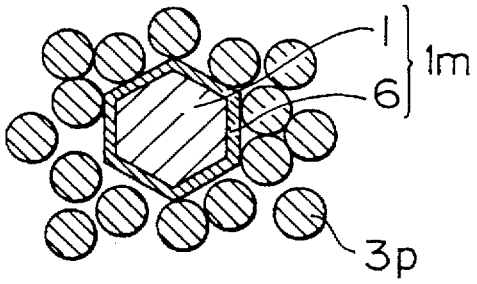
FIG. 7 is a schematic sectional view illustrating a portion of a method of producing a porous ultrafine grinder using metal-coated ultrafine abrasive grains.

The grinder of this embodiment can be produced by mixing the binder grains 3*p* and metal-coated ultrafine abrasive grains 1 m, which were previously obtained by coating the surfaces of the ultrafine abrasive grains 1 with a metal layer 6 consisting of Ti, Ni, Fe, Si, Ta, W, Cr or Co, as shown in FIG. 7, followed by molding and sintering under suitable temperature and pressure.

The surfaces of the ultrafine abrasive grains 1 may be coated with the metal layer 6 by any one of conventional known means such as plating, vacuum vapor deposition, sputtering, etc.

Embodiment 6

A grinder of Embodiment 6 was produced by using metal-coated ultrafine abrasive grains 1 m, which was obtained by coating the surfaces of diamond abrasive grains with a Ni metal layer 6, and binder grains 3*p* of Ni powder.

The metal-coated ultrafine abrasive grains 1 m obtained by coating 43% by weight of Ni on the ultrafine abrasive grains 1 of #1000 synthetic diamond single crystal, and Ni powder having an average grain size of 5 μm were mixed at a ratio by volume of 25 (ultrafine abrasive grains):32 (binder). A doughnut-shaped die of a spark plasma sintering apparatus was filled with the resultant powder mixture, followed by sintering at 680° to 780° C. under compression at 10 MPa to 20 MPa and application of a pulse current.

The grinder of this embodiment obtained by the above-mentioned method was a doughnut-shaped disk having an outer diameter of 92 mm, an inner diameter of 40 mm and a thickness of 0.45 mm, and had a porosity of 27%.

An end of the grinder, which was about 10 mm, was dressed to a thickness of 0.25 mm by using GC #240 stick, and used in a grinding test by the constant-pressure grinding method using as a workpiece to be ground a $Al_2O_3$.TiC ceramic sample having a sectional area of 5 mm by 2 mm.

As a result of the test, the grinder could grind the workpiece to be ground at a grinding speed of 0.2 $mm^3$/sec. under a grinding pressure of 0.5 MPa. This indicates that the grinder of Embodiment 6 has sufficiently practical strength even with a thickness of 0.25 mm, and is capable of cutting, at a high speed, a high-hardness workpiece to be ground having a thickness of 2 mm or more with a grinding allowance of 0.3 mm or less.

When grains of #1000 synthetic diamond single crystal, which were coated with Ni, were used as the ultrafine abrasive grains 1, and Ni grains having a grain size of 5 μm were used as the binder 3, the relations of the sintering temperature and sintering pressure and the porosity of the resultant grinder produced by the SPS method were measured. The results obtained are shown in Table 5. When grains of #1000 synthetic diamond single crystal, which were coated with Ni, were used as the ultrafine abrasive grains 1 m, and cast iron grains having a grain size of 5 μm were used as the binder 3, the relations of the sintering temperature and sintering pressure and the porosity of the resultant grinder produced by the SPS method were measured. The results obtained are shown in Table 6.

TABLE 5

| Sintering temperature | Sintering pressure | Porosity |
|---|---|---|
| 640° C. | 10 MPa | 41.0% |
| 680° C. | 5 MPa | 41.3% |
| 680° C. | 10 MPa | 36.8% |
| 680° C. | 20 MPa | 33.6% |
| 740° C. | 10 MPa | 31.7% |

TABLE 6

| Sintering temperature | Sintering pressure | Porosity |
|---|---|---|
| 660° C. | 10 MPa | 36.0% |
| 700° C. | 5 MPa | 36.9% |
| 700° C. | 10 MPa | 31.5% |
| 700° C. | 20 MPa | 25.5% |
| 740° C. | 10 MPa | 26.3% |

A porous ultrafine grinder in a further embodiment of the present invention will be described below.

The porous ultrafine grinder of this embodiment comprises a fused phase 7 containing Cu or Ag.

The thickness of the fused phase 7 formed in the interfaces of the ultrafine abrasive grains 1 and the binder 3 depends upon the sintering temperature, pressure and time. As described above, in the grinder of this embodiment, the thickness of the fused phase must be controlled to 1.5 μm or less. However, on the other hand, the sintering temperature, pressure and time also affect the bonding strength between the respective binder grains 3*p*. Namely, in order to enhance the physical strength of the grinder of this embodiment to a level which allows the use as a sharp-edge grinder, it is necessary for enhancing the bonding strength between the binder grains 3*p* to appropriately select the sintering temperature, pressure and time.

Under the selected conditions, if the thickness of the fused phase 7 exceeds 1.5 μm, means is required for controlling the generation of the fused phase 7.

Since Cu and Ag have the effect of suppressing the growth of the fused phases 7, the thickness of the fused phase 7 can be controlled by appropriately adding Cu or Ag. Therefore, if one of such metals is present between the ultrafine abrasive grains 1 and the binder 3, even under the sintering conditions where the respective binder grains 3*p* are strongly bonded, the fused phase 7 is not excessively grown.

Since both Cu and Ag are soft metals, if the fused phase is thick, the grinder sometimes cannot maintain hardness required as a grinder. The thickness of the fused phase 7 containing Cu or Ag is thus preferably 20% or less of the grain size of the ultrafine abrasive grains 1.

For example, when the fused phase 7 contain Cu and Fe, it is possible to form a hard coating. In this case, since the coating easily peels off due to a thermal change, the thickness of the fused phase 7 is preferably 20% or less of the grain size of the ultrafine abrasive grains 1.

The grinder of this embodiment comprising the fused phase 7 containing Cu or Ag can be produced by mixing binder grains and ultrafine abrasive grains which were previously obtained by coating to a thickness of 1.5 μm or less the ultrafine abrasive grains 1 with the binder component containing Cu or Ag, followed by molding and sintering under appropriate temperature and pressure.

The surfaces of the ultrafine abrasive grains 1 may be coated with the binder component containing Cu or Ag by any one of conventional known techniques such as plating, vacuum vapor deposition, sputtering, etc.

The porous ultrafine grinder of the present invention comprises the ultrafine abrasive grains of diamond or cBN having an average grain size of 60 μm or less, and the binder which can form the fused phase with the ultrafine abrasive grains. The binder is a porous material, and the fused phase is formed in the interfaces of the binder and the ultrafine abrasive grains. Since the thickness of the fused phase is 1.5 μm, the bonding strength between the ultrafine abrasive grains and the binder is high in spite of the porous structure, thereby causing excellent dressing properties, preventing breaking, loading and dulling, and achieving high grinding efficiency and physical strength which allows the use as a sharp-edge grinder having a thickness of, for example, 0.3 mm or less.

If the fused phase comprises the ultrafine abrasive grains and Ni, Fe, Cr or Co, no crack occurs in the interfaces of the fused phases and the ultrafine abrasive grains because the fused phase is relatively soft, thereby further enhancing the bonding between the ultrafine abrasive grains and the binder.

If the fused phase contain Cu or Ag, since Cu or Ag has low affinity for the ultrafine abrasive grains, the thickness of the fused phases is not excessively increased according to the sintering conditions, thereby preventing occurrence of cracks.

What is claimed is:

1. A porous ultrafine grinder comprising:

ultrafine abrasive grains selected from one of diamond and cubic boron nitride and having an average grain size of 60 μm or less; and a binder which forms a fused phase by fusion with the ultrafine abrasive grains under heating;

wherein the binder comprises a porous material having continuous pores, and the fused phase is formed in the interfaces of the binder and the ultrafine abrasive grains and has a thickness of 1.5 μm or less.

2. A porous ultrafine grinder according to claim 1, wherein the ultrafine abrasive grains are coated with at least one metal selected from the group consisting of Ti, Ni, Fe, Si, Ta, W, Cr, and Co.

3. A porous ultrafine grinder according to claim 1, wherein the fused phase further contains Cu or Ag.

4. A porous ultrafine grinder according to claim 1, wherein the thickness of the fused phase is within the range of 0.05 to 0.5 μm.

5. A porous ultrafine grinder according to claim 1, wherein the porosity is within the range of 5 to 60%.

6. A porous ultrafine grinder according to claim 1, wherein the porosity is within the range of 5 to 45%.

7. A porous ultrafine grinder according to claim 1, wherein the binder is selected from the group consisting of single elements of Fe, Cu, Ni, Co, Cr, Ta, V, Nb, W, Ti, Si and Zr; carbides of Co, Cr, Ta, W, Ti, Si and Zr; oxides of Ti, Si, Al, Ce, Mg, Fe and Zr; nitrides of Ta, Ti and Si; borides of Ta, Ti and Si; and mixtures thereof.

8. A porous ultrafine grinder according to claim 7, wherein the ultrafine abrasive grains are coated with at least one metal selected from the group consisting of Ti, Ni, Fe, Si, Ta, W, Cr, and Co.

9. A porous ultrafine grinder according to claim 7, wherein the fused phase further contains Cu or Ag.

10. A method of producing a porous ultrafine grinder comprising the steps of:

mixing ultrafine abrasive grains selected from one of diamond and cubic boron nitride said abrasive gains having an average grain size of 60 μm or less, and binder grains to form a powder mixture;

molding the powder mixture; and sintering the molded product at a temperature and pressure which are controlled to form a fused phase having a thickness of 1.5 μm or less in the interfaces of the ultrafine abrasive grains and the binder grains and a porosity if 5 to 60%.

11. A method of producing a porous ultrafine grinder according to claim 10, wherein the sintering is performed by a spark plasma sintering process at a sintering temperature within the range of 600° to 2000° and sintering pressure within the range of 5 to 50 MPa.

12. A method of producing a porous ultrafine grinder according to claim 10, wherein the sintering is performed by a hot press sintering process at a sintering temperature within the range of 600° to 2000° and sintering pressure within the range of 5 to 50 MPa.

13. A method of producing a porous ultrafine grinder according to claim 10, wherein the sintering step is performed at temperature and pressure which are controlled to form the fused phase having a thickness within the range of 0.05 to 0.5 μm in the interfaces of the ultrafine abrasive grains and the binder grains.

14. A method of producing a porous ultrafine grinder according to claim 10, wherein the sintering step is performed at temperature and pressure which are controlled to produce porosity within the range of 5 to 45%.

15. A method of producing a porous ultrafine grinder according to claim 10, wherein the ultrafine abrasive grains are coated with a metal selected from the group consisting of Ti, Ni, Fe, Si, Ta, W, Cr and Co to form a metal layer having a thickness of 1.5 μm or less, said layer forming, upon sintering, a fused phase between the abrasive grains and the binder grains.

16. A method of producing a porous ultrafine grinder according to claim 10 wherein the powder mixture further includes one of Cu or Ag.

17. A method of producing a porous ultrafine grinder according to claim 10, wherein the binder grains are selected from the group consisting of single elements of Fe, Cu, Ni, Co, Cr, Ta, V, Nb, W, Ti, Si and Zr; carbides of Co, Cr, Ta, W, Ti, Si and Zr; oxides of Ti, Si, Al, Ce, Mg, Fe and Zr; nitrides of Ta, Ti and Si; borides of Ta, Ti and Si; and mixtures thereof; and the average grain size of the binder grains is within the range of 5 to 50% of the average grain size of the ultrafine abrasive grains.

18. A method of producing a porous ultrafine grinder according to claim 17, wherein the sintering is performed by a spark plasma sintering process at a sintering temperature within the range of 600° to 2000° C. and sintering pressure within the range of 5 to 50 MPa.

19. A method of producing a porous ultrafine grinder according to claim 17, wherein the sintering is performed by a hot press sintering process at a sintering temperature within the range of 600° to 2000° C. and sintering pressure within the range of 5 to 50 MPa.

* * * * *

UNITED STATES PATENT AND TRADEMARK OFFICE

CERTIFICATE OF CORRECTION

PATENT NO. : 5,718,736

DATED : February 17, 1998

INVENTOR(S) : Hitoshi Onishi et al.

It is certified that error appears in the above-indentified patent and that said Letters Patent is hereby corrected as shown below:

In claim 10, line 4, replace "gains" with --grains--.

In claim 10, line 12, replace "if" with --of--.

Signed and Sealed this

Twelfth Day of January, 1999

*Attest:*

*Attesting Officer*

*Acting Commissioner of Patents and Trademarks*